US007407266B2

(12) United States Patent
Kimura et al.

(10) Patent No.: US 7,407,266 B2
(45) Date of Patent: Aug. 5, 2008

(54) INK CONTAINER AND INK CONTAINER LOADING STRUCTURE

(75) Inventors: Kaoru Kimura, Ami-machi (JP); Tomohiro Ogawa, Ami-machi (JP); Sigeyuki Chuugun, Ami-machi (JP)

(73) Assignee: Riso Kagaku Corporation, Tokyo (JP)

( * ) Notice: Subject to any disclaimer, the term of this patent is extended or adjusted under 35 U.S.C. 154(b) by 403 days.

(21) Appl. No.: 10/546,549

(22) PCT Filed: Dec. 19, 2003

(86) PCT No.: PCT/JP03/16317

§ 371 (c)(1),
(2), (4) Date: Aug. 23, 2005

(87) PCT Pub. No.: WO2004/073993

PCT Pub. Date: Sep. 2, 2004

(65) Prior Publication Data

US 2006/0152538 A1 Jul. 13, 2006

(30) Foreign Application Priority Data

Feb. 24, 2003 (JP) ..... 2003-045567
Oct. 10, 2003 (JP) ..... 2003-351826

(51) Int. Cl.
*B41J 29/393* (2006.01)
*B41J 2/14* (2006.01)

(52) U.S. Cl. ..... 347/49; 347/19

(58) Field of Classification Search ..... 347/7, 347/19, 49, 85, 86, 87; 399/12, 24
See application file for complete search history.

(56) References Cited

U.S. PATENT DOCUMENTS 6,074,042 A 6/2000 Gasvoda et al.
6,130,695 A 10/2000 Childers et al.
6,286,949 B1 9/2001 Lewis et al.
6,290,343 B1 9/2001 Lewis et al.
6,322,205 B1 11/2001 Childers et al.
6,385,407 B1 * 5/2002 Inose ..... 399/24
6,402,309 B1 * 6/2002 Litman ..... 347/86
6,533,383 B1 * 3/2003 Saruta et al. ..... 347/19

(Continued)

FOREIGN PATENT DOCUMENTS

EP 1 182 520 2/2002

(Continued)

*Primary Examiner*—Anh T. N. Vo
(74) *Attorney, Agent, or Firm*—Mathew K. Ryan; Frommer Lawrence and Haug LLP

(57) ABSTRACT

An image forming system includes a mounting portion in which an expendable provided with a memory in which distinguishment information representing whether the expendable is compatible is stored is removably installed. The distinguishment information stored in the memory of the expendable installed in the mounting portion is read out, and operation of a predetermined object is controlled on the basis of a control information according to the distinguishment information when the distinguishment information read out represents that the expendable is compatible. A control information input mechanism for inputting control information of the object when the distinguishment information read out represents that the expendable is incompatible is further provided and the operation of the object is controlled on the basis of the control information input by the control information input mechanism when the distinguishment information read out from the memory of the expendable represents that the expendable is incompatible.

3 Claims, 8 Drawing Sheets

U.S. PATENT DOCUMENTS

| | | | | |
|---|---|---|---|---|
| 6,547,363 | B1 * | 4/2003 | Shinada et al. | 347/19 |
| 6,588,880 | B1 | 7/2003 | Gasvoda et al. | |
| 6,619,789 | B2 | 9/2003 | Childers et al. | |
| 6,697,578 | B2 * | 2/2004 | Watanabe et al. | 399/12 |
| 6,871,588 | B2 | 3/2005 | Sasaki et al. | |
| 6,935,716 | B2 * | 8/2005 | Hatasa et al. | 347/19 |
| 6,984,020 | B2 * | 1/2006 | Shinada et al. | 347/49 |
| 7,152,953 | B2 * | 12/2006 | Haan et al. | 347/49 |
| 2002/0024571 | A1 | 2/2002 | Childers et al. | |
| 2002/0031357 | A1 | 3/2002 | Watanabe et al. | |
| 2002/0035940 | A1 | 3/2002 | Sasaki et al. | |
| 2002/0047881 | A1 | 4/2002 | Lewis et al. | |
| 2002/0085075 | A1 | 7/2002 | Shinada et al. | |
| 2003/0103774 | A1 | 6/2003 | Watanabe et al. | |
| 2003/0108355 | A1 | 6/2003 | Watanabe et al. | |
| 2003/0227501 | A1 | 12/2003 | Hatasa et al. | |
| 2004/0027432 | A1 | 2/2004 | Childers et al. | |

FOREIGN PATENT DOCUMENTS

| | | |
|---|---|---|
| EP | 1 219 448 | 7/2002 |
| JP | 2-148360 | 12/1990 |
| JP | 10-133529 | 5/1998 |
| JP | 2000-15916 | 1/2000 |
| JP | 2002-72784 | 3/2002 |
| JP | 2002-172843 | 6/2002 |
| JP | 2002-254673 | 9/2002 |

* cited by examiner

INK CONTAINER AND INK CONTAINER LOADING STRUCTURE

FIELD OF THE INVENTION

This invention relates to an ink container loading structure formed by an ink container provided with a storage means in which predetermined information is stored and an ink container loading portion in which the ink container is loaded, the ink container loading portion, and the ink container.

BACKGROUND OF THE INVENTION

There have been used a removable ink container, for instance, in a stencil printer for the reason of easiness in handling or the like. The above-mentioned ink containers are removed when the ink therein is exhausted to be discarded or to be recycled and a new ink container is mounted on the stencil printer thereafter to continuously make print.

For example, in Japanese Unexamined Patent Publication No. 10(1998)-133529, there is proposed an ink container provided with a storage means such as an IC memory, and the consumption of the ink and/or the date and time of use of the ink, for instance, in a stencil printer in which the ink container is installed is stored in the IC memory. Further, in Japanese Unexamined Patent Publication No. 10(1998)-133529, there is proposed a method of obtaining information on the using conditions of, for instance, the stencil printer by reading out the date and time of use of the ink and the consumption of the ink thus stored in the memory IC.

Further, in Japanese Unexamined Patent Publication No. 10(1998)-133529, there is proposed a method of obtaining data from the memory IC in non-contact by providing the memory IC on the ink container with a data communication portion which reads out and transmits data stored in the memory IC, and by providing a stencil printer in which the ink container is installed with a read-out means having an antenna or the like for receiving the data transmitted from the data communication portion.

However, when the data is to be read out in non-contact from the memory IC, it is difficult to suitably deliver and receive the data unless the memory IC provided with the data communication portion and the read-out means provided with the antenna are within a limited space.

Further, not only in the case where the data is to be read out in non-contact from the memory IC, but also in the case where the data is to be read out through a connector or the like from the memory IC, it is necessary to hold the space between the memory IC and the read-out means within a limited distance according to, for instance, the shape of the connector connecting the memory IC and the read-out means.

Further, since the ink container can be bulged when the components of the ink filled in the ink container are soaked therein, there is a fear that the memory IC can be brought into contact with the read-out means to be damaged by bulging of the ink container if the space between the read-out means and the memory IC is fixed too small. Accordingly, it is necessary to set wide the space between the read-out means and the memory IC, which gives rise to a problem that the sensitivity of the antenna deteriorates.

In order to detect at a high sensitivity with the read-out means, it is preferred that the surface on which the memory IC is mounted in the ink container and the surface on which the read-out means is mounted be parallel to each other. However, the surface on which the memory IC is mounted can incline due to the ink container manufacturing error, and when such inclination fluctuate, it is difficult to make the surface on which the memory IC is mounted and the surface on which the read-out means is mounted parallel to each other and to detect at a high sensitivity and delivery and receipt of data between the read-out means and the memory IC sometimes cannot be suitably performed.

In view of the foregoing observations and description, the primary object of the present invention is to provide an ink container loading structure formed by an above-mentioned ink container and an above-mentioned ink container loading portion described above, an ink container loading portion, and an ink container, where delivery and receipt of data between the read-out means and the storage means can be always suitably performed by suitably positioning the read-out means and the storage means.

SUMMARY OF THE INVENTION

In accordance with the present invention, there is provided a first ink container loading structure comprising an ink container provided with a storage means in which predetermined information is stored and an ink container loading portion in which the ink container is loaded and is provided with a read-out means for reading out the information stored in the storage means, wherein the improvement comprises that the ink container loading portion is provided with an ink container movement limiting portion which limits movement of the ink container toward the storage means in the direction in which the storage means and the read-out means are opposed to each other so that the space between the read-out means and the storage means does not become not smaller than a predetermined value.

The "storage means" may be any so long as predetermined data can be recorded in or can be read out from it and may be a memory IC or a bar code.

The "read-out means" may be, when the storage means comprises a memory IC, those which can read out the data from the memory IC by way of the electrical contact. Further, when the storage means comprises a memory IC having a data communication portion, the read-out means may be those which are provided with an antenna and can read out the data in non-contact by receiving the data transmitted from the data communication portion. Further, when the storage means comprises a bar code, the read-out means may be those which can read out the bar code.

In the first ink container loading structure, when the ink container is provided with a protrusion or a recessed portion, the ink container movement limiting portion may limit movement of the ink container by limiting movement of the protrusion or the recessed portion toward the storage means in the direction in which the storage means and the read-out means are opposed to each other.

The shape of the protrusion or the recessed portion and the shape of the ink container movement limiting portion may be any so long as, for instance, the protrusion or the recessed portion is brought into engagement with the ink container movement limiting portion to limit movement of the protrusion or the recessed portion.

In accordance with the present invention, there is further provided a second ink container loading structure comprising a cylindrical ink container provided with a storage means in which predetermined information is stored and an ink container loading portion in which the ink container is loaded and which is provided with a read-out means for reading out the information stored in the storage means, wherein the improvement comprises that the ink container is provided with a protrusion or a recessed portion, and the ink container loading portion is provided with a fixing portion which causes the storage means and the read-out means to be positioned opposed to each other by fixing the position of the protrusion or the recessed portion in the circumferential direction of the ink container.

The shape of the fixing portion may be any so long as, for instance, it is brought into engagement with the protrusion or the recessed portion to fix the position of the protrusion or the recessed portion.

In accordance with the present invention, there is further provided a third ink container loading structure comprising cylindrical ink container provided with a storage means in which predetermined information is stored and an ink container loading portion in which the ink container is loaded and is provided with a read-out means for reading out the information stored in the storage means, wherein the improvement comprises that the ink container is provided with a protrusion or a recessed portion, and the ink container loading portion is provided with an ink container movement limiting portion which limits movement of the protrusion or the recessed portion toward the storage means in the direction in which the storage means and the read-out means are opposed to each other so that the space between the read-out means and the storage means does not become not smaller than a predetermined value and a fixing portion which causes the storage means and the read-out means to be positioned opposed to each other by fixing the position of the protrusion or the recessed portion in the circumferential direction of the ink container.

The "ink container movement limiting portion" and the "fixing portion" may be separately formed or may be integrally formed.

In accordance with the present invention, there is further provided a fourth ink container loading structure comprising an ink container provided with a storage means in which predetermined information is stored and an ink container loading portion in which the ink container is loaded and is provided with a read-out means for reading out the information stored in the storage means, wherein the improvement comprises that the ink container loading portion is provided with a holding base which is supported to be movable back and forth toward the storage means of the ink container, an urging means which urges the holding base toward the storage means of the ink container and a read-out means installment member which is supported for rotation on the holding base and in which the read-out means is installed.

The expression "movable back and forth" may be, for instance, that the holding base is linearly movable back and forth or that the holding base is movable back and forth by rotation thereof.

When the holding base is movable back and forth by rotation thereof, it is preferred that the axis of rotation of the holding base be in parallel to the axis of rotation of the read-out means installment member.

Further, in the fourth ink container loading structure, the ink container loading portion may be further provided with an ink container movement limiting portion which limits movement of the ink container toward the storage means in the direction in which the storage means and the read-out means are opposed to each other so that the space between the read-out means and the storage means does not become not smaller than a predetermined value.

Further, while the ink container is cylindrical and is provided with a protrusion or a recessed portion, the ink container loading portion may be provided with a fixing portion which causes the storage means and the read-out means to be positioned opposed to each other by fixing the position of the protrusion or the recessed portion in the circumferential direction of the ink container.

In accordance with the present invention, there is further provided a first ink container loading portion which is employed in the first ink container loading structure and is characterized by having an ink container movement limiting portion which limits movement of the ink container toward the storage means in the direction in which the storage means and the read-out means are opposed to each other so that the space between the read-out means and the storage means does not become not smaller than a predetermined value.

In accordance with the present invention, there is further provided a second ink container loading portion which is employed in the second ink container loading structure and is characterized by having a fixing portion which causes the storage means and the read-out means to be positioned opposed to each other by fixing the position of the protrusion or the recessed portion in the circumferential direction of the ink container.

In accordance with the present invention, there is further provided a third ink container loading portion which is employed in the third ink container loading structure and is characterized by having an ink container movement limiting portion which limits movement of the protrusion or the recessed portion toward the storage means in the direction in which the storage means and the read-out means are opposed to each other so that the space between the read-out means and the storage means does not become not smaller than a predetermined value and a fixing portion which causes the storage means and the read-out means to be positioned opposed to each other by fixing the position of the protrusion or the recessed portion in the circumferential direction of the ink container.

In accordance with the present invention, there is further provided a fourth ink container loading portion which is employed in the fourth ink container loading structure and is characterized by having a holding base which is supported to be movable back and forth toward the storage means of the ink container, an urging means which urges the holding base toward the storage means of the ink container and a read-out means installment member which is supported for rotation on the holding base and in which the read-out means is installed.

The ink container of the present invention is employed in the first to third ink container loading structures and is provided with a protrusion or a recessed portion.

In the first ink container loading structure, the first ink container loading portion and the first ink container of the present invention, since the ink container movement limiting portion limits movement of the ink container toward the storage means in the direction in which the storage means and the read-out means are opposed to each other, the space between the read-out means and the storage means does not become too large and delivery and receipt of data between the read-out means and the storage means can be always suitably performed. Further, even while printing is being performed using ink in the ink container, the distance between the storage means and the read-out means can be prevented from increasing due to, for instance, vibration of the system by the printing.

In the second ink container loading structure, the second ink container loading portion and the second ink container of the present invention, since the ink container is provided with a protrusion or a recessed portion, and the storage means and the read-out means is caused to be positioned opposed to each other by fixing the position of the protrusion or the recessed portion in the circumferential direction of the ink container by the fixing portion of the ink container loading portion, delivery and receipt of data between the read-out means and the storage means can be always suitably performed. Further, even while printing is being performed using ink in the ink container, the ink container can be prevented from being rotated due to, for instance, vibration of the system by the printing.

In the third ink container loading structure, the third ink container loading portion and the third ink container of the present invention, since the ink container is provided with a protrusion or a recessed portion and movement of the ink container toward the storage means in the direction in which the storage means and the read-out means are opposed to each other is limited by the ink container movement limiting portion so that the space between the read-out means and the storage means does not become not smaller than a predetermined value, and the storage means and the read-out means is caused to be positioned opposed to each other by fixing the position of the protrusion or the recessed portion in the circumferential direction of the ink container by the fixing portion of the ink container loading portion, the space between the read-out means and the storage means does not become too large, the ink container can be prevented from being rotated in the ink container loading portion so that the storage means and the read-out means is caused to be always positioned opposed to each other even if the ink container is cylindrical in shape and delivery and receipt of data between the read-out means and the storage means can be always suitably performed. Further, even while printing is being performed using ink in the ink container, the ink container can be prevented from being rotated or moved due to, for instance, vibration of the system by the printing so that the read-out means cannot correctly read out data from the storage means.

In the fourth ink container loading structure and the fourth ink container loading portion of the present invention, since the ink container loading portion is provided with a holding base which is supported to be movable back and forth toward the storage means of the ink container, an urging means which urges the holding base toward the storage means of the ink container and a read-out means installment member which is supported for rotation on the holding base and in which the read-out means is installed, the holding base is moved toward the storage means of the ink container under the urging force of the urging means and the read-out means installment member mounted on the holding base is rotated in contact with the part in which the read-out means is installed when the ink container is loaded in the ink container loading portion. Accordingly, the positional relation between the read-out means in the read-out means installment member and the storage means can be always held parallel even if the ink container is somewhat deformed and the space therebetween can be held constant, whereby delivery and receipt of data between the read-out means and the storage means can be always suitably performed.

Further, in the fourth ink container loading structure, when the ink container loading portion is provided with an ink container movement limiting portion which limits movement of the ink container toward the storage means in the direction in which the storage means and the read-out means are opposed to each other so that the space between the read-out means and the storage means does not become not smaller than a predetermined value, the distance between the storage means and the read-out means can be prevented from increasing due to, for instance, vibration of the system by the printing and accordingly, the space between the storage means and the read-out means can be held constant, whereby delivery and receipt of data between the read-out means and the storage means can be more stably performed.

Further, in the fourth ink container loading structure, when the ink container is provided with a protrusion or a recessed portion and the ink container loading portion is provided with a fixing portion which causes the storage means and the read-out means to be positioned opposed to each other by fixing the position of the protrusion or the recessed portion in the circumferential direction of the ink container, the ink container can be prevented from being rotated in the ink container loading portion and accordingly, the space between the storage means and the read-out means can be held constant, whereby delivery and receipt of data between the read-out means and the storage means can be more stably performed.

PREFERRED EMBODIMENTS OF THE INVENTION

An ink container loading structure in accordance with a first embodiment of the present invention will be described, hereinbelow, with reference to the drawings.

Figure 1:
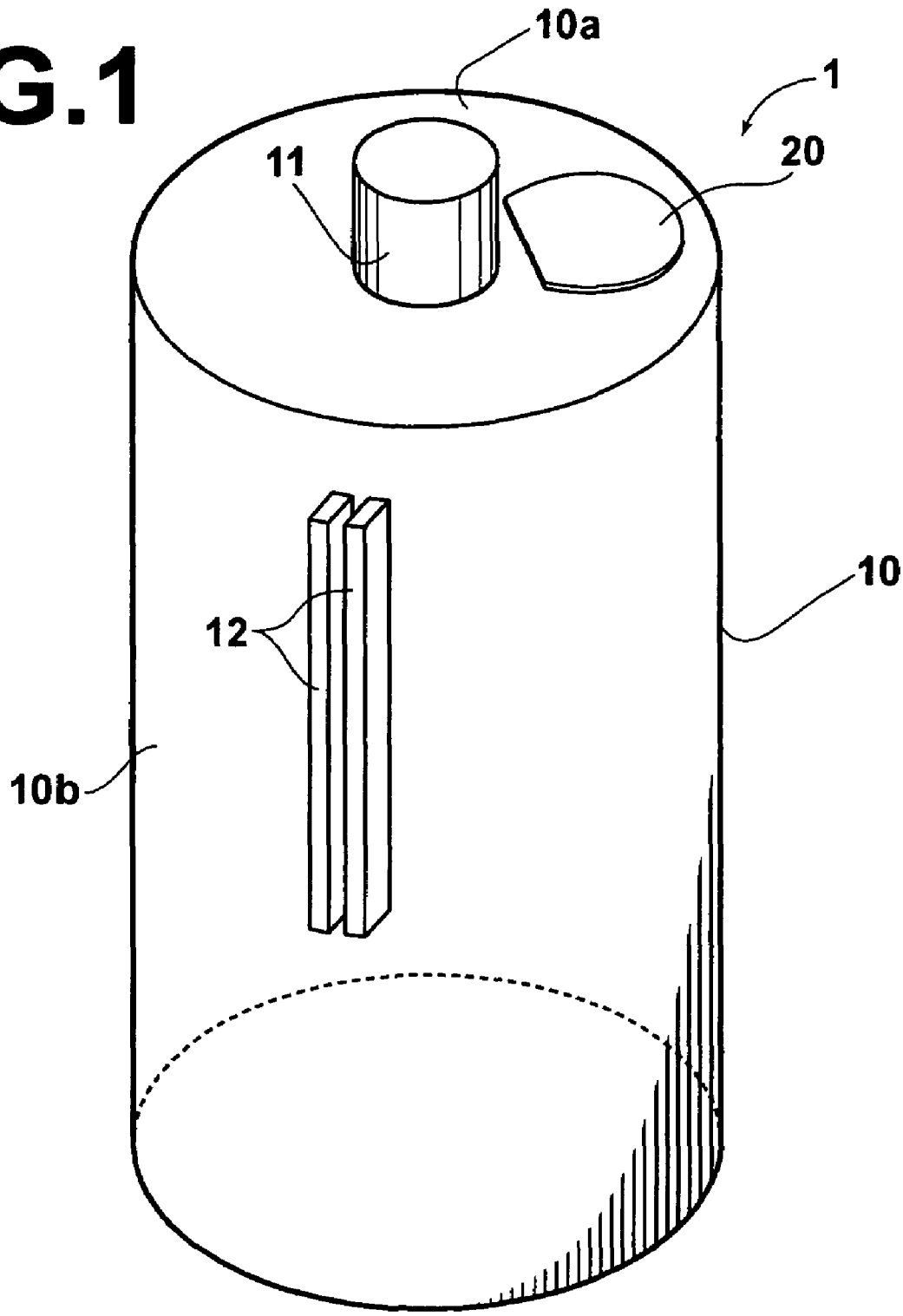
FIG. 1 is a perspective view showing an ink container used in an ink container loading structure in accordance with a first embodiment of the present invention.

An ink container used in the ink container loading structure in accordance with the first embodiment of the present invention will be described first. FIG. 1 is a perspective view showing an ink container used in the ink container loading structure of this embodiment.

As shown in FIG. 1, the ink container 1 used in the ink container loading structure comprises a substantially cylindrical ink container body 10 of resin and a storage means 20. A discharge port 11 through which ink filled in the ink container body 10 is discharged is provided in an upper end face

10*a* of the ink container body 10, and the storage means 20 is provided in a part of the upper end face 10*a* of the ink container body 10. The storage means 20 is a memory IC having a data communication portion. Further, as shown in FIG. 1, a pair of ribs 12 each in the form of a flat plate are provided in parallel to the central axis of the ink container body 10 on a side 10*b* thereof.

Figure 2A:
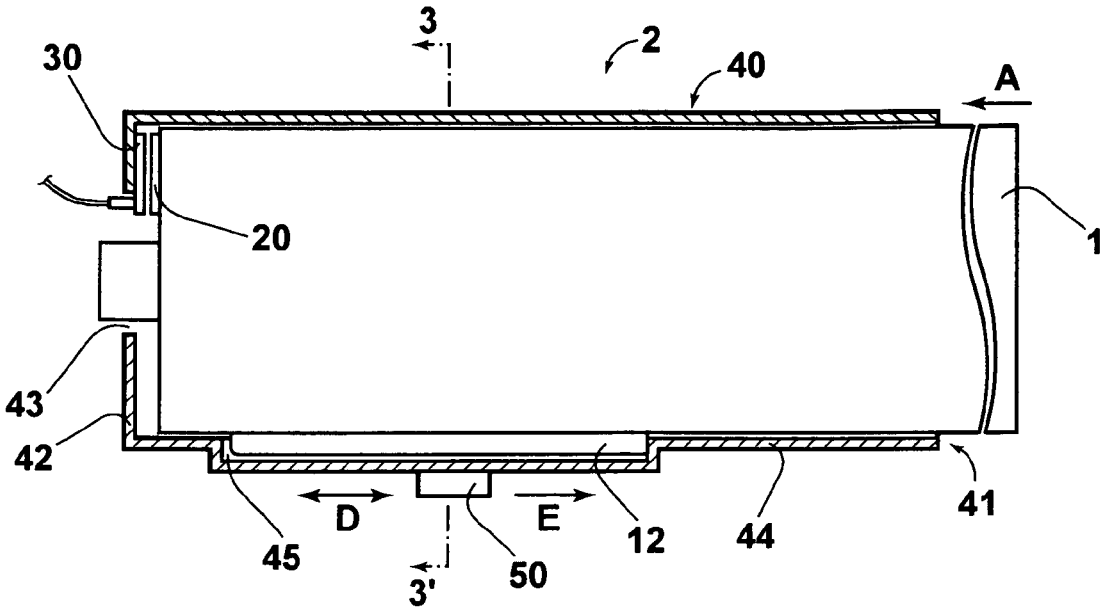
FIG. 2A is a cross-sectional view of an ink container loading portion used in the ink container loading structure in accordance with an embodiment of the present invention loaded with an ink container shown in FIG. 1.

An ink container loading portion used in the ink container loading structure in accordance with the first embodiment of the present invention will be described next. FIG. 2A is a cross-sectional view of an ink container loading portion used in the ink container loading structure loaded with an ink container 1.

The ink container loading portion 2 used in the ink container loading structure is substantially of a cylinder which is larger in diameter than the ink container 1 and is formed of resin and comprises an ink container loading portion body 40 in which the ink container is loaded, a read-out means 30 which reads out predetermined information from the storage means 20 on the ink container 1 and a fixing portion 50 to be described later, as shown in FIG. 2A. The ink container loading portion body 40 is in the form of a cylinder which has no circular end wall at one end thereof, and the end provided with no circular end wall forms an ink container insertion port 41. Into the ink container insertion port 41, the ink container 1 is inserted in the direction of arrow A. A circular wall 42 at the other end of the ink container loading portion body 40 is provided with a hole 43 through which the ink discharge port 11 of the inserted ink container 1 projects outside. An ink suction pump which sucks the ink from the ink container 1, and the like are connected to the ink discharge port 11 of the ink container 1 projected through the hole 43. A read-out means 30 is provided on the inner side of the circular wall 42 as shown in FIG. 2A.

Figure 2B:
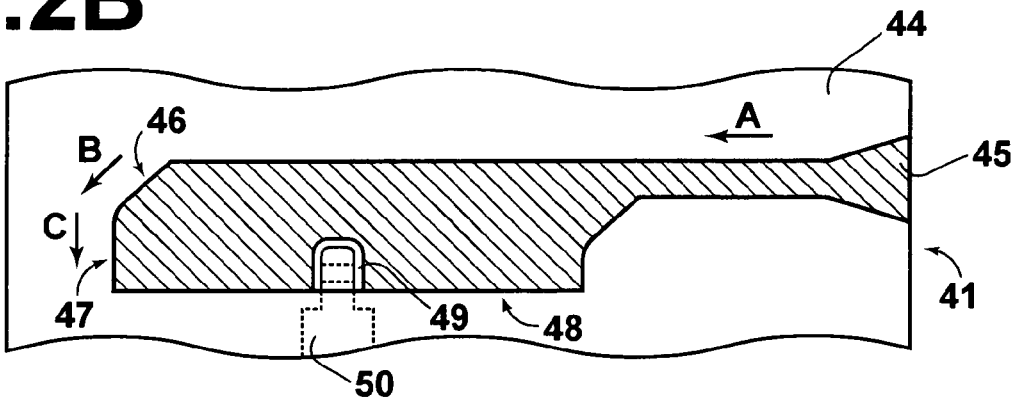
FIG. 2B is a development showing the inner side of the side portion of the ink container loading portion.

A groove 45 by which the ribs 12 on the ink container body 10 is guided and fixed is formed on a part of the inside of a side portion 44 of the ink container loading portion body 40 as shown FIG. 2B. As shown FIG. 2B, the groove 45 comprises a longitudinal guide portion which guides the ribs 12 on the ink container 1 in the direction of arrow A when the ink container 1 is inserted into the ink container insertion port 41 in the direction of arrow A, an oblique guide portion which guides the ribs 12 on the ink container 1 in the direction of arrow B by causing the end of the ribs 12 to slide along a surface 46 after guided in the direction of arrow A, and a circumferential guide portion which, when the end of the ribs 12 abut against a surface 47 after the ribs 12 are guided by the oblique guide portion, guides the end of the ribs 12 along the surface 47 in the direction of arrow C so that the ribs 12 are brought into abutment against and fixed by a surface 48. The part near the ink container insertion port 41 of the longitudinal guide portion is wider than a linear portion to facilitate insertion of the ribs 12 on the ink container 1. Further, the width of the circumferential guide portion in the direction of arrow A is formed to conform to the length of the ribs 12 so that when the ribs 12 abut against the surface 48, the position of the ribs 12 in the direction of arrow D (the direction in which the storage means 20 and the read-out means 30 are opposed to each other) is fixed. In the ink container loading structure of this particular embodiment, the ribs 12 on the ink container 1 and the groove 45 on the ink container loading portion 2 are positioned so that the space between the storage means 20 and the read-out means 30 does not become not smaller than a predetermined value when the ribs 12 on the ink container 1 abut against the surface 48 of the groove 45 and the position of the ribs 12 in the direction of arrow D is fixed as shown in FIG. 2A. Further, the space is selected so that the read-out means 30 can suitably communicate with the storage means 20 to suitably read out the data from the storage means 20.

Though, the position of the ribs 12 in the direction of arrow D is fixed by the groove 45 in this embodiment, it is not necessary to fix the position of the ribs 12 in the direction of arrow D so long as the position of the ribs 12 is limited from being moved in the direction of the arrow E (toward the storage means 20 in the direction in which the storage means 20 and the read-out means 30 are opposed to each other.

Further, as shown in FIG. 2B, a hole 49 is formed in the ink container loading portion body 40. The hole 49 is formed so that the fixing portion 50 (to be described later) formed on the outer side of the side portion 44 of the ink container loading portion body 40 is brought into abutment against the ribs 12 when the ribs 12 is brought into abutment against the surface 48 of the groove 45.

Figure 3:
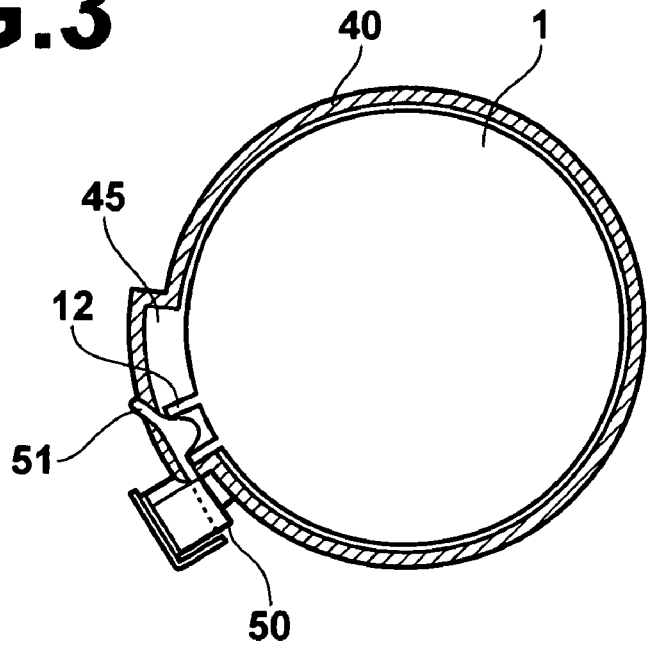
FIG. 3 is a cross-sectional view of the ink container loading portion taken along line 3-3 in FIG. 2A.

FIG. 3 is a cross-sectional view taken along line 3-3 in FIG. 2A showing the ink container loading portion 2 and the ink container 1 shown in FIG. 2A. As shown in FIG. 3, the fixing portion 50 is formed on the outer side of the side portion 44 of the ink container loading portion body 40. The fixing portion 50 is provided with a spring switch 51 having a projection and when the ink container 1 is loaded in the ink container loading portion 2, the projection of the spring switch 51 is engaged with the space between the two ribs 12 of the ink container 1 to fix the position of the ribs 12 of the ink container 1 in the circumferential direction. The ribs 12 on the ink container 1, the hole 49 and the fixing portion 50 of the ink container loading portion 2 are located so that the storage means 20 and the read-out means 30 are opposed to each other.

When the ink container 1 provided with the ribs 12 in the manner described above is loaded in the ink container loading portion 2 provided with the groove 45, the hole 49 and the fixing portion 50 in the manner described above, the ink container 1 is inserted in the direction of arrow A with the ribs 12 on the ink container 1 guided in the direction of arrow A by the longitudinal direction guide portion of the groove 45. Then the ink container 1 is rotated in its circumferential direction and at the same time is further inserted in the direction of arrow A as the ribs 12 are guided in the direction of arrow B after the end of the ribs 12 guided in the direction of arrow A is brought into abutment against surface 46 of the oblique guide portion and the end of the ribs 12 slides along the surface 46, and is further rotated in its circumferential direction as the ribs 12 are guided in the direction of arrow C with the end thereof slid along the surface 47 after the end of the ribs 12 guided in the direction of arrow B abuts against the surface 47 of the circumferential guide portion. When the ribs 12 on the ink container 1 are brought into abutment against the surface 48, the position of the ribs 12 in the direction of arrow D is fixed by the surface 48 and at the same time, the projection of the spring switch 51 is engaged with the space between the two ribs 12 of the ink container 1 to fix the position of the ribs 12 of the ink container 1 in the circumferential direction.

By fixing the position of the ribs 12 in the manner described above, the space between the storage means 20 of the ink container 1 and the read-out means 30 of the ink container mounting portion 2 does not become not smaller than a predetermined value and at the same time the storage means 20 and the read-out means 30 can be positioned opposed to each other, whereby delivery and receipt of data between the storage means 20 and the read-out means 30 can be always suitably performed.

Though, in the ink container loading structure in the embodiment described above, the positions of the storage means 20 and the read-out means 30 in the direction in which they are opposed to each other are fixed by respectively providing the ink container 1 and the ink container loading portion 2 with the ribs 12 and the groove 45 and rotation of the ink container 1 in a circumferential direction is fixed by providing the ink container loading portion 2 with the fixing portion 50, only the positions of the storage means 20 and the read-out means 30 in the direction in which they are opposed to each other may be fixed, or only rotation of the ink container 1 in a circumferential direction may be fixed.

Further, though, in the ink container loading structure in the embodiment described above, the ribs 12 are provided on the ink container 1 and movement of the ribs 12 are controlled by the groove 45, it is not necessary to provide a protrusion such as ribs 12 on the ink container 1 but a surface of the ink container 1, for instance, the bottom surface thereof may be used. For example, movement of the ink container 1 may be controlled by bringing the bottom surface into abutment against the ink container movement limiting portion.

Further, though, in the ink container loading structure in the embodiment described above, the positions of the storage means 20 and the read-out means 30 in the direction in which they are opposed to each other are fixed by respectively providing the ink container 1 and the ink container loading portion 2 with the ribs 12 and the groove 45, the positions of the storage means 20 and the read-out means 30 in the direction in which they are opposed to each other are fixed may be fixed or the ink container 1 may be prevented from being moved toward the storage means 20 in the direction in which they are opposed to each other by other arrangements without limited to such arrangement. Further, rotation of the ink container 1 in a circumferential direction may also be fixed by other arrangements.

An ink container loading structure in accordance with a second embodiment of the present invention will be described, hereinbelow.

Figure 4:
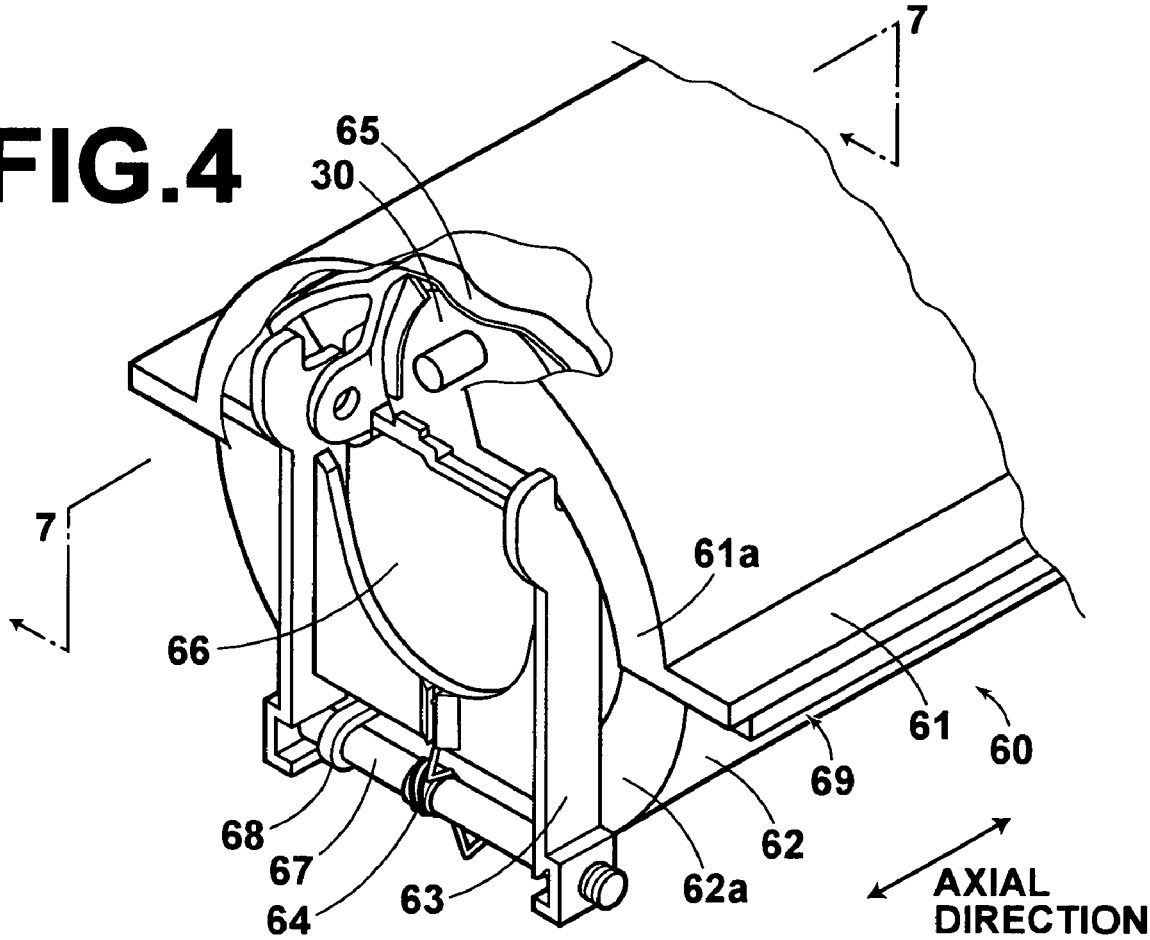
FIG. 4 is a perspective view showing an ink container loading structure in accordance with a second embodiment of the present invention.

The ink container loading structure of this embodiment has an ink container loading portion 60 which comprises, as shown in FIG. 4, an ink container loading portion body 69 formed by upper and lower semi-cylindrical members, that is, an upper ink container loading portion body 61 and a lower ink container loading portion body 62, a holding base 63 which is supported to be movable back and forth toward the storage means 20 of the ink container 1 loaded in the cylinder of the ink container loading portion body 69, an urging means 64 urging the holding base 63 toward the storage means 20 of the ink container 1 and a read-out means installment member 65 which is mounted for rotation on the holding base 63. Further, a support shaft 67 supporting the holding base 63 and a shaft fixing portion 68 for fixing the support shaft 67 to the lower ink container loading portion body 62 are provided on the lower ink container loading portion body 62.

The ink container loading portion body 69 is provided with a groove 45, by which ribs 12 on the ink container body 10 is guided and fixed, on a part of the inside of a side portion as in the ink container loading portion 2 of the first embodiment and a fixing portion the same as the fixing portion 50 of the first embodiment. The holding base 63 is mounted on the lower ink container loading portion body 62 so that when the ink container 1 is fixed by the groove 45 and the fixing member, the storage 20 of the ink container 1 and the read-out means installment member 65 are opposed to each other. The upper and lower ink container loading portion bodies 61 and 62 are respectively provided in their end walls 61*a* and 62*a* with semi-circular cutaway portions for forming a hole 66 through which the ink discharge port 11 of the ink container 1 projects outside the ink container loading portion body 69. Further, in FIG. 4, a part of the upper ink container loading portion body 61 is abbreviated in order to clearly show the positional relation between the ink container loading portion body 69 and the read-out means installment member 65. Though, in this particular embodiment, the groove and the fixing portion are provided on the ink container loading portion body 69, it is not essential.

Figure 5:
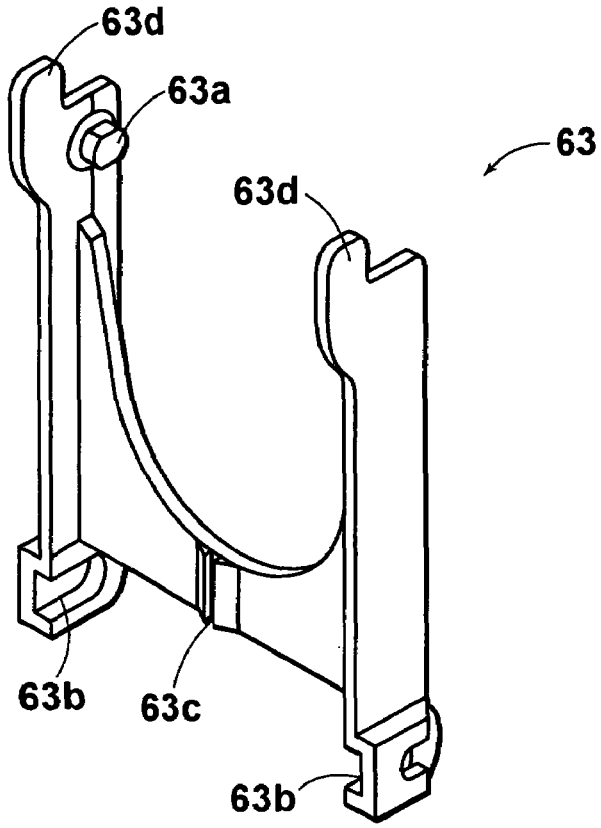
FIG. 5 is a perspective view showing the holding base shown in FIG. 4.

FIG. 5 is a perspective view in an enlarged scale of the holding base 63 shown in FIG. 4. As shown in FIG. 5, the holding base 63 is U-shaped and comprises a support portion 63*a* on which the read-out means installment member 65 is mounted for rotation, a bearing portion 63*b* on which the support shaft 67 supporting the holding base 63 to be movable back and forth toward the storage means 20 of the ink container 1, a spring groove 63*c* against which a part of the urging means 64 abuts and a hook portion 63*d* which suppress the holding base 63 from being moved toward the storage means 20.

Figure 6:
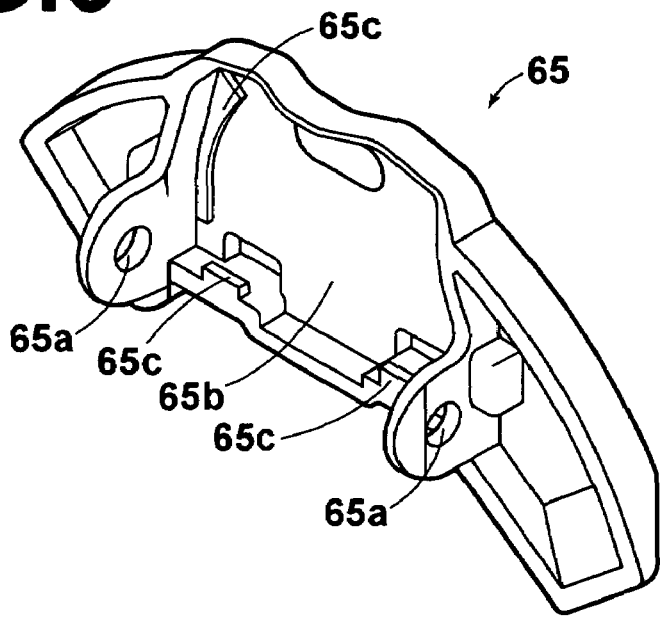
FIG. 6 is a perspective view showing the read-out means installment member shown in FIG. 4.

FIG. 6 is a perspective view in an enlarged scale of the read-out means installment member 65 shown in FIG. 4. As shown in FIG. 6, the read-out means installment member 65 is articulate to conform to the shape of the upper ink container loading portion body 61 and the ink container 1 and comprises a hole 65*a* with which the support portion 63*a* of the holding base 63 is engaged for rotation, a mounting surface 65*b* on which the read-out means 30 is mounted, and an engagement portion 65*c* which engages with the read-out means 30 on the mounting surface 65*b*.

The urging means 64 shown in FIG. 4 is in the form of a spring which are received in the spring groove 63*c* of the holding base 63 at one end and engaged with the lower ink container loading portion body 62 at the other end, thereby urging the holding base 63 toward the storage means 20 of the ink container 1.

Figure 7:
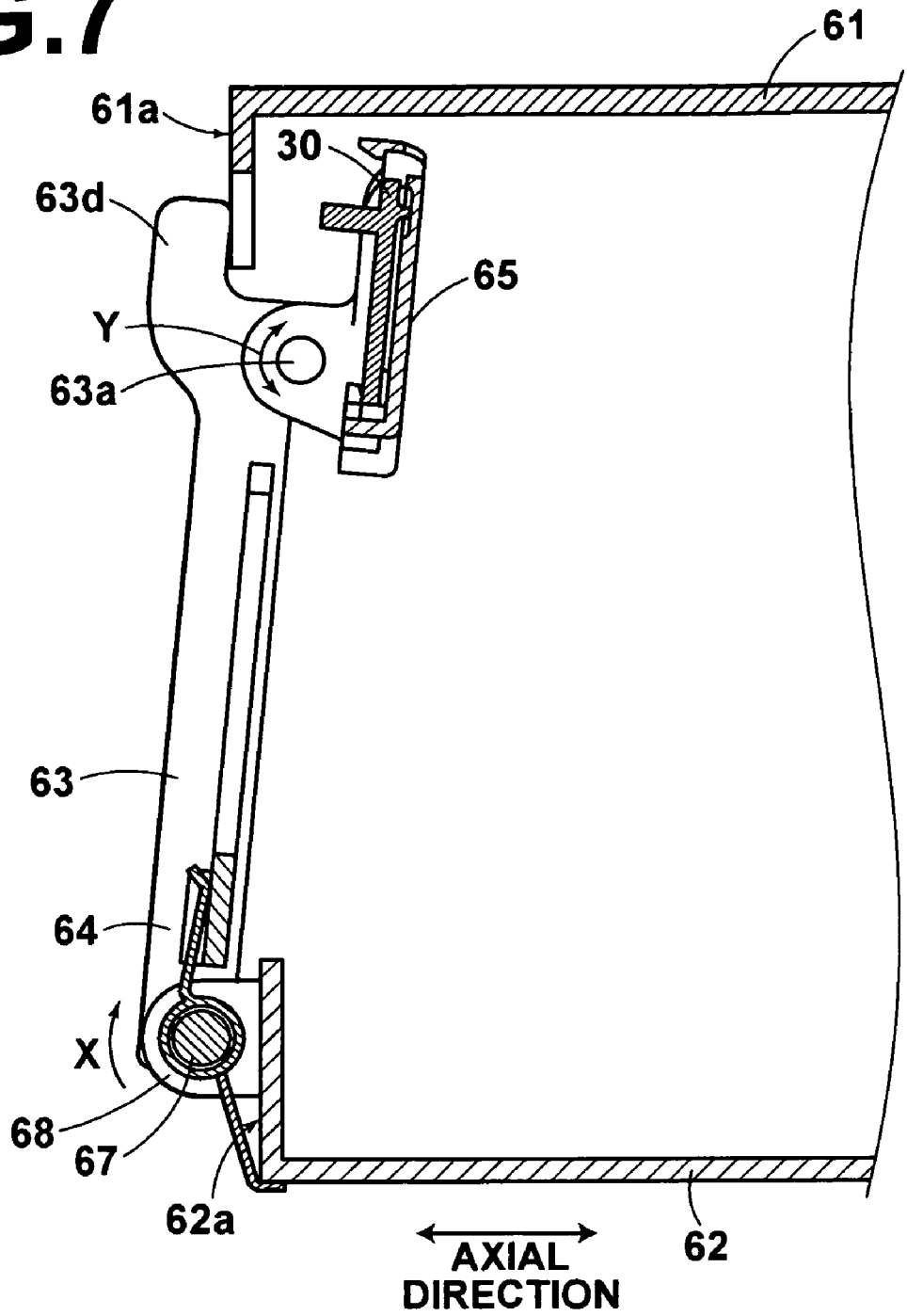
FIG. 7 is a cross-sectional view of the ink container loading portion taken along line 7-7 in FIG. 4.

FIG. 7 is a cross-sectional view taken along line 7-7 of the ink container loading portion 60 shown in FIG. 4. The ink container loading portion 60 shown in FIG. 7 is in a state before loading an ink container.

As can be seen from FIGS. 4 and 7, the upper and lower ink container loading portion bodies 61 and 62 are combined with each other with their end walls 61*a* and 62*a* shifted in the axial direction of the ink container loading portion body 69 and at the same time, with the end wall 61*a* of the upper ink container loading portion body 61 positioned between the hook portion 63*d* of the holding base 63 and the read-out means installment member 65. Further, the holding base 63 is mounted on the support shaft 67 to be movable back and forth about the support shaft 67 between a position where the hook portion 63*d* of the holding base 63 abuts against the end wall 61*a* and a position where the read-out means installment member 65 abuts against the back surface of the end wall 61*a*. That is, before the ink container 1 is loaded in the ink container loading portion 60, the holding base 63 is urged in the direction of arrow X1, that is, toward the storage means 20 by the urging means 64 so that its hook portion 63*d* is supported in abutment against the end wall 61*a* of the upper ink container loading portion body 61 and the read-out means installment member 65 is rotatable in the direction of arrow Y.

Figure 8:
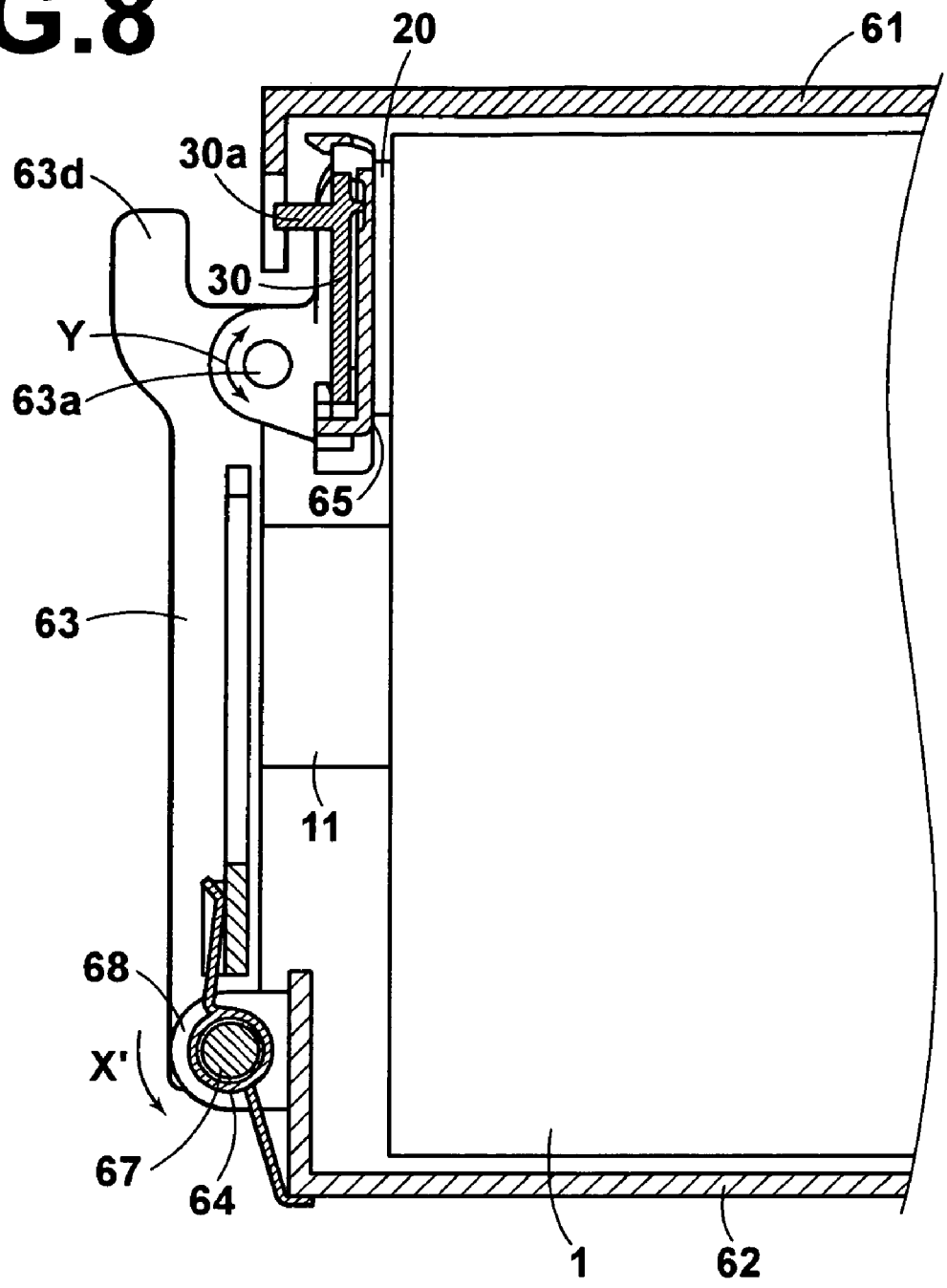
FIG. 8 is a view showing the state where an ink container is loaded in the ink container loading portion shown in FIG. 7.

FIG. 8 is a view showing a state where the ink container loading portion 60 shown in FIG. 7 is loaded with an ink container 1. When the ink container loading portion 60 is loaded with an ink container 1, the storage means 20 of the ink container 1 abuts against the read-out means installment member 65, the read-out means installment member 65 is moved in synchronization with movement of the ink container 1 in the direction of insertion, and the holding base 63 supported for rotation in the directions of arrows X1 and X2 is moved in the direction of arrow X2 together with the read-out means installment member 65 as shown in FIG. 8. At this time, since the holding base 63 is urged in the direction of arrow X1 by the urging means 64, the read-out means installment member 65 mounted for rotation in the direction of arrow Y on the holding base 63 is rotated about the support portion 63*a* along the storage means 20. As a result, the read-out means installment member 65 and the storage means 20 are positioned in parallel to each other, and the space between the read-out means 30 installed in the read-out means installment member 65 and the storage means 20 can be held constant. Further, a cutaway portion which permits a projection 30*a* on the read-out means 30 to pass through is formed in a part of the end wall 61*a*.

Figure 9:
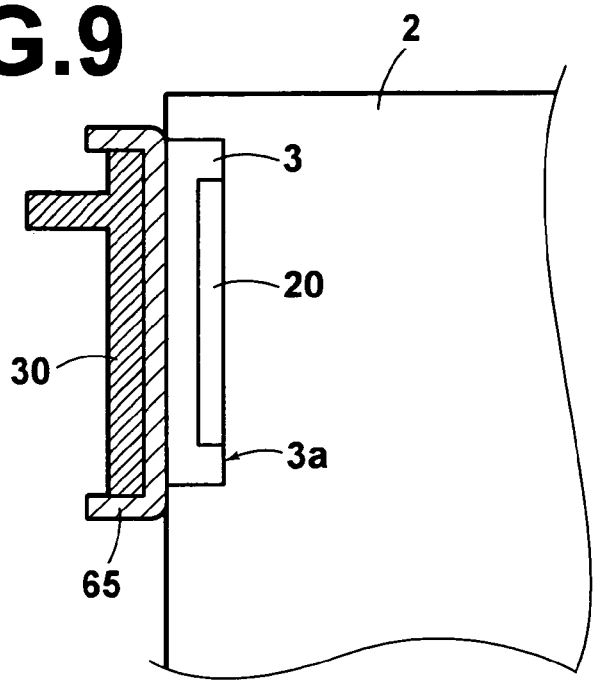
FIG. 9 is a view for illustrating an ink container loading structure in accordance with another embodiment of the present invention.

Though, in the embodiment described above, the storage means 20 and the read-out means installment member 65 are in direct contact with each other, by providing a recess 3 in the ink container 2, placing the storage means 20 on a bottom surface 3*a* of the recess 3 and bringing the read-out means installment member 65 and a periphery of the recess 3 in contact with each other as shown in FIG. 9, the read-out means 30 may be positioned along the storage means 20 to hold constant the space between the read-out means 30 and the storage means 20. Further, it is possible to hold constant the space between the storage means 20 and the read-out means 30 by providing a protrusion around the storage means 20 of the ink container 2 and causing the read-out means installment member 65 to be in contact with the protrusion.

Figure 10:
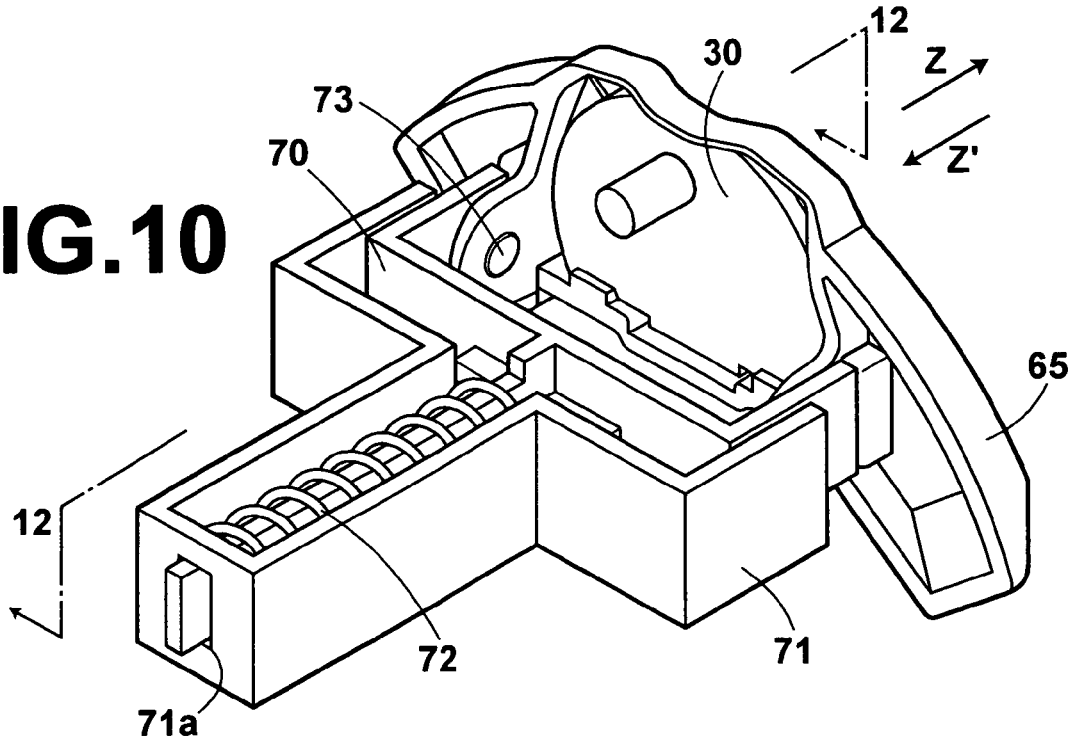
FIG. 10 is a view for illustrating an ink container loading structure in accordance with still another embodiment of the present invention.

The arrangement of the holding base 63 and the like in the second embodiment need not be limited to the illustrated arrangement but may be of other arrangements. For example, it is possible to form a T-shaped holding base 70, to provide the holding base 70 with a support shaft 73 which supports for rotation the read-out means installment member 65 and to support the holding base 70 to be linearly movable back and forth toward the storage means 20 on the ink container 1 as shown in FIG. 10. Specifically, the holding base 70 may be mounted as shown in FIG. 10, a fixing member 71 which supports the holding base 70 to be movable back and forth toward the storage means 20 of the ink container 1 may be provided in the upper ink container loading body portion 61, and the holding base 70 may be urged toward the storage means 20 on the ink container 1 (toward the direction of arrow Z1) by an urging means 72 such as a spring provided in the fixing member 71. A plan view of the holding base 70 and the fixing member 71, and the like shown in FIG. 10 is shown in FIG. 11, and a cross-sectional view taken along line 12-12 in FIG. 10 is shown in FIG. 12.

Figure 11:
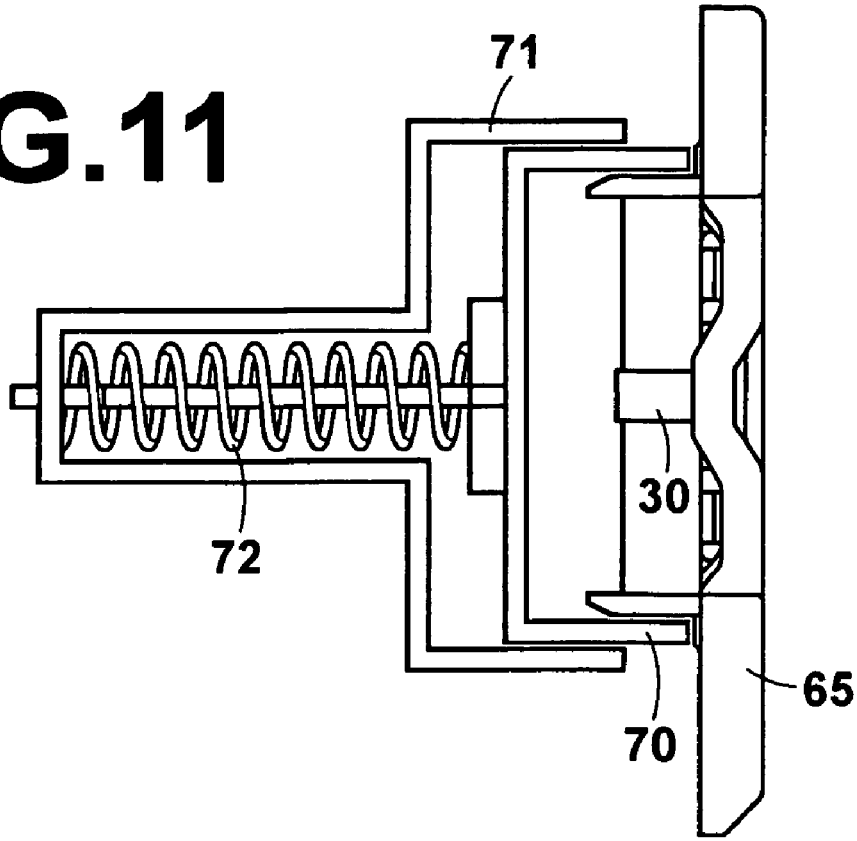
FIG. 11 is a plan view showing the holding base shown in FIG. 10.
Figure 12:
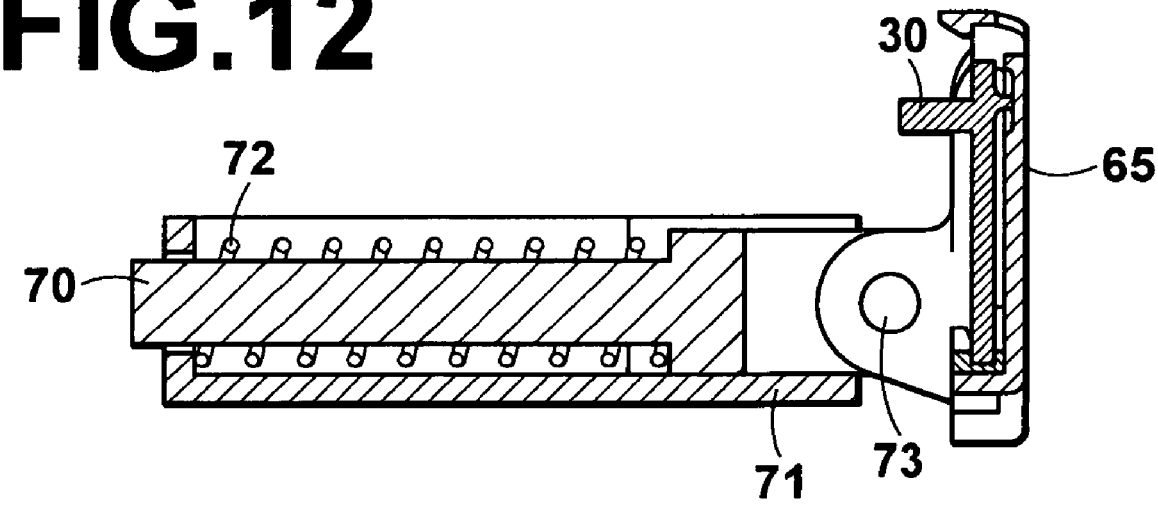
FIG. 12 is a cross-sectional view of the holding base taken along line 12-12 in FIG. 10.

In the ink container loading portion provided with the holding base 70 and the fixing member 71, and the like shown in FIGS. 10 to 12, the storage means 20 on the ink container 1 is brought into abutment against the read-out means installment member 65 when the ink container 1 is loaded, the read-out means installment member 65 is moved in response to movement of the ink container 1 in the direction of loading, and the holding base 70 is moved in the direction of arrow Z2 in response to movement of the read-out means installment member 65 together with the read-out means installment member 65. Since the holding base 70 is urged in the direction arrow Z1 by the urging means 72, the read-out means installment member 65 mounted for rotation on the holding base 63 is rotated about the support portion 70 along the storage means 20. As a result, the read-out means installment member 65 and the storage means 20 are positioned in parallel to each other, and the space between the read-out means 30 installed in the read-out means installment member 65 and the storage means 20 can be held constant.

The shape and the arrangement of the holding base, urging means, read-out means installment member and the like in the second embodiment need not be limited to the illustrated shape and arrangement but may be of other shapes and arrangements.

The invention claimed is:

1. An ink container loading structure comprising an ink container provided with a storage means in which predetermined information is stored and an ink container loading portion in which the ink container is loaded and is provided with a read-out means for reading out the information stored in the storage means, wherein the improvement comprises that the ink container loading portion is provided with a holding base which is supported to be movable back and forth toward the storage means of the ink container;

an urging means which urges the holding base toward the storage means of the ink container; and a read-out means installment member which is supported for rotation on the holding base and in which the read-out means is installed.

2. An ink container loading structure as defined in claim 1 further comprising an ink container movement limiting portion which limits movement of the ink container toward the storage means in the direction in which the storage means and the read-out means are opposed to each other so that the space between the read-out means and the storage means does not become not smaller than a predetermined value.

3. An ink container loading structure as defined in claim 1 in which the ink container is cylindrical and is provided with a protrusion or a recessed portion; and the ink container loading portion is provided with a fixing portion which causes the storage means end the read-out means to be positioned opposed to each other by fixing the position of the protrusion or the recessed portion in the circumferential direction of the ink container.

* * * * *